US010906297B2

(12) United States Patent
Nitta

(10) Patent No.: US 10,906,297 B2
(45) Date of Patent: Feb. 2, 2021

(54) LIQUID EJECTION DEVICE AND IMAGE FORMING DEVICE

(71) Applicant: TOSHIBA TEC KABUSHIKI KAISHA, Tokyo (JP)

(72) Inventor: Noboru Nitta, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/547,613

(22) Filed: Aug. 22, 2019

(65) Prior Publication Data

US 2020/0070505 A1 Mar. 5, 2020

(30) Foreign Application Priority Data

Aug. 28, 2018 (JP) ..... 2018-159765
Nov. 15, 2018 (JP) ..... 2018-214296

(51) Int. Cl.
*B41J 2/045* (2006.01)
*B41J 2/03* (2006.01)

(52) U.S. Cl.
CPC ..... *B41J 2/04525* (2013.01); *B41J 2/03* (2013.01); *B41J 2/04546* (2013.01); *B41J 2/04588* (2013.01)

(58) Field of Classification Search
CPC ..... B41J 2/04503; B41J 2/04505; B41J 2/04506; B41J 2/04508; B41J 2/04513; B41J 2/04515; B41J 2/04516; B41J 2/04525; B41J 2/04535; B41J 2/04551; B41J 2/04573; B41J 2/04583; B41J 2/04588; B41J 2/0459; B41J 2/04591; B41J 2/04593; B41J 2/04595
See application file for complete search history.

(56) References Cited

U.S. PATENT DOCUMENTS

| | | | |
|---|---|---|---|
| 2007/0200885 | A1 | 8/2007 | Hibi |
| 2010/0079544 | A1 | 4/2010 | Sumi |
| 2012/0281047 | A1 | 11/2012 | Barbet |
| 2016/0075132 | A1 | 3/2016 | Kitaoka et al. |
| 2018/0207932 | A1 | 7/2018 | Kusunoki |

FOREIGN PATENT DOCUMENTS

| | | |
|---|---|---|
| JP | 2010-194801 | 9/2010 |
| JP | 2013-091215 | 5/2013 |

OTHER PUBLICATIONS

Extended European Search Report for European Patent Application No. 19193115.3 dated Apr. 14, 2020.

*Primary Examiner* — Kristal Feggins
(74) *Attorney, Agent, or Firm* — Amin, Turocy & Watson, LLP

(57) ABSTRACT

According to one embodiment, a liquid ejection device includes a nozzle plate in which nozzles for ejecting liquid are arranged, an actuator, a liquid supply unit, and a drive control unit. The actuator is provided in each of the nozzles. The liquid supply unit communicates with the nozzles. When one of a plurality of nozzles is given attention, the drive control unit gives drive signals to actuators of nozzles adjacent in an X direction and a Y direction, to drive the actuators at a timing shifted by a predetermined amount, such as half of a drive period, from a timing of an actuator of the nozzle given attention.

9 Claims, 12 Drawing Sheets

FIG. 9A
CHANNEL NUMBER
| | | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| 1 | 9 | 17 | 25 | 33 | 41 | 49 | 57 | 65 | 73 | 81 | 89 | 97 | 105 | 113 | 121 | 129 | 137 | 145 | 153 | 161 | 169 | 177 | 185 | 193 | 201 | 209 | | |
| | 8 | 16 | 24 | 32 | 40 | 48 | 56 | 64 | 72 | 80 | 88 | 96 | 104 | 112 | 120 | 128 | 136 | 144 | 152 | 160 | 168 | 176 | 184 | 192 | 200 | 208 | | |
| | 7 | 15 | 23 | 31 | 39 | 47 | 55 | 63 | 71 | 79 | 87 | 95 | 103 | 111 | 119 | 127 | 135 | 143 | 151 | 159 | 167 | 175 | 183 | 191 | 199 | 207 | | |
| | 6 | 14 | 22 | 30 | 38 | 46 | 54 | 62 | 70 | 78 | 86 | 94 | 102 | 110 | 118 | 126 | 134 | 142 | 150 | 158 | 166 | 174 | 182 | 190 | 198 | 206 | | |
| | 5 | 13 | 21 | 29 | 37 | 45 | 53 | 61 | 69 | 77 | 85 | 93 | 101 | 109 | 117 | 125 | 133 | 141 | 149 | 157 | 165 | 173 | 181 | 189 | 197 | 205 | 213 | |
| | 4 | 12 | 20 | 28 | 36 | 44 | 52 | 60 | 68 | 76 | 84 | 92 | 100 | 108 | 116 | 124 | 132 | 140 | 148 | 156 | 164 | 172 | 180 | 188 | 196 | 204 | 212 | |
| | 3 | 11 | 19 | 27 | 35 | 43 | 51 | 59 | 67 | 75 | 83 | 91 | 99 | 107 | 115 | 123 | 131 | 139 | 147 | 155 | 163 | 171 | 179 | 187 | 195 | 203 | 211 | |
| | 2 | 10 | 18 | 26 | 34 | 42 | 50 | 58 | 66 | 74 | 82 | 90 | 98 | 106 | 114 | 122 | 130 | 138 | 146 | 154 | 162 | 170 | 178 | 186 | 194 | 202 | 210 | |
Y
X
FIG. 9B
VOLTAGE VALUE (mV) INDICATING MAGNITUDE OF PRESSURE AMPLITUDE
| | | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| 12 | 13 | 14 | 16 | 17 | 19 | 21 | 21 | 22 | 24 | 25 | 27 | 31 | 32 | 33 | 30 | 27 | 25 | 25 | 24 | 21 | 20 | 18 | 17 | 16 | 15 | 15 | | |
| | 13 | 14 | 15 | 17 | 19 | 20 | 20 | 23 | 24 | 27 | 31 | 36 | 36 | 36 | 34 | 31 | 27 | 25 | 23 | 21 | 20 | 19 | 17 | 16 | 16 | 16 | | |
| | 16 | 15 | 15 | 17 | 19 | 19 | 21 | 23 | 25 | 28 | 33 | 38 | 42 | 42 | 39 | 34 | 28 | 25 | 24 | 22 | 20 | 18 | 17 | 16 | 16 | 15 | | |
| | 15 | 14 | 15 | 16 | 19 | 19 | 21 | 23 | 25 | 30 | 36 | 43 | 53 | 62 | 50 | 39 | 32 | 26 | 24 | 23 | 21 | 19 | 17 | 16 | 16 | 14 | | |
| | 12 | 13 | 14 | 16 | 19 | 19 | 20 | 21 | 25 | 32 | 39 | 48 | 73 | [illegible] | 65 | 46 | 35 | 30 | 24 | 23 | 22 | 19 | 17 | 16 | 14 | 13 | 13 | |
| | 12 | 12 | 14 | 14 | 17 | 18 | 19 | 21 | 25 | 32 | 40 | 51 | 88 | [illegible] | 88 | 52 | 39 | 31 | 25 | 22 | 21 | 18 | 17 | 14 | 13 | 12 | 12 | |
| | 12 | 10 | 11 | 13 | 15 | 16 | 18 | 20 | 26 | 35 | 42 | 53 | 74 | 136 | 81 | 55 | 43 | 37 | 29 | 23 | 20 | 17 | 15 | 13 | 11 | 10 | 11 | |
| | 11 | 11 | 9.4 | 11 | 13 | 14 | 16 | 20 | 26 | 34 | 43 | 54 | 69 | 81 | 74 | 60 | 47 | 39 | 29 | 23 | 18 | 16 | 13 | 11 | 11 | 9.2 | 9.2 | |
FIG. 9C
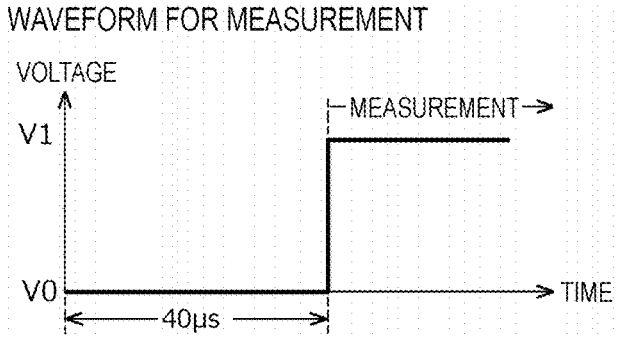
FIG. 10
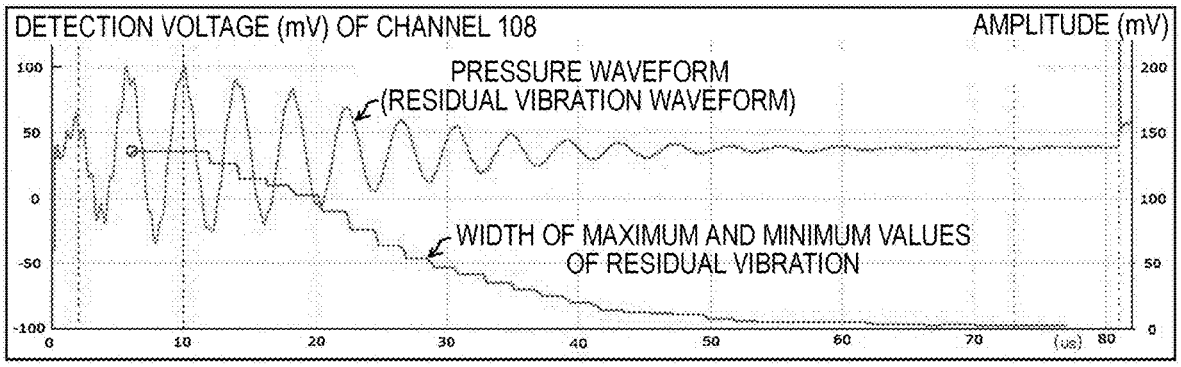

VOLTAGE VALUE (mV) INDICATING MAGNITUDE OF PRESSURE

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 5.1 | 6 | 8.3 | 12 | 13 | 15 | 17 | 14 | 12 | 10 | 6.1 | 2.8 | 1.7 | 1.3 | 1.6 | 1.8 | 3.1 | 3.9 | 11 | 12 | 14 | 14 | 11 | 10 | 8.3 | 4.6 | 2.4 | |
| | 5.4 | 6.3 | 9.6 | 11 | 15 | 15 | 14 | 11 | 6.3 | 3.3 | 0.7 | -3 | -2 | 0.1 | -2 | -0 | 1.5 | 7 | 10 | 13 | 14 | 13 | 9.3 | 6.4 | 2.7 | 0.8 | |
| | 5.1 | 5.5 | 8 | 10 | 12 | 13 | 12 | 9.1 | 3.8 | 0.3 | -1 | -1 | 7.2 | 7.7 | 1.5 | -4 | -1 | 1.2 | 8.8 | 11 | 12 | 11 | 8.7 | 6.4 | 1.8 | 0.9 | |
| | 4.2 | 5.8 | 7.4 | 9.7 | 10 | 12 | 10 | 6.8 | 1 | -2 | -3 | 1.7 | 16 | 22 | 11 | -3 | -5 | -5 | 4.5 | 8.2 | 10 | 9.9 | 7.4 | 6.6 | 3 | 1.2 | |
| | 4.8 | 4.5 | 6.4 | 9.4 | 9.4 | 10 | 8.3 | 3 | -1 | -5 | -5 | 3.5 | 37 | 98 | 26 | 1 | -7 | -5 | -0 | 5.2 | 7.7 | 9.8 | 7.3 | 7 | 4.1 | 2.1 | 3.9 |
| | 5.9 | 5.1 | 6.7 | 8.9 | 8.9 | 9.6 | 7.1 | 2.7 | -3 | -7 | -7 | 3.2 | 46 | | 48 | 2.6 | -9 | -8 | -3 | 2.8 | 6.4 | 8.8 | 7.3 | 7.1 | 5.1 | 3.9 | 5.9 |
| | 7 | 6.3 | 7.6 | 7.7 | 7 | 7.4 | 4.8 | 1.8 | -4 | -9 | -8 | -2 | 23 | 85 | 34 | 1.3 | -9 | -10 | -6 | 0.5 | 3.3 | 5.7 | 6.7 | 6.9 | 6.2 | 4.3 | 5.5 |
| | 8.5 | 8 | 8.3 | 8.2 | 6.6 | 6.7 | 3.3 | -0 | -6 | -8 | -7 | -7 | 10 | 23 | 18 | -1 | -3 | -8 | -7 | -2 | 2.2 | 3.5 | 5.3 | 6.1 | 6.9 | 5.5 | 6.5 |

DRIVE TIMING

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | | | | | |
| | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | | | | | |
| | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | | | | | |
| | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | | | | | |
| | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | | | | |
| | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | | | | |
| | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | | | | |
| | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | A1 | B2 | A2 | B1 | | | | |

LIQUID EJECTION DEVICE AND IMAGE FORMING DEVICE

CROSS-REFERENCE TO RELATED APPLICATIONS

This application is based upon and claims the benefit of priority from Japanese Patent Application Nos. 2018-159765, filed on Aug. 28, 2018 and 2018-214296, filed on Nov. 15, 2018, the entire contents of both of which are incorporated herein by reference.

FIELD

Embodiments described herein relate generally to a liquid ejection device and an image forming device.

BACKGROUND

There is known a liquid ejection device which supplies a predetermined amount of liquid to a predetermined position. The liquid ejection device is mounted on an inkjet printer, a 3D printer, a dispensing device, or the like. The inkjet printer ejects ink droplets from an ink jet head to form an image or the like on a surface of a recording medium. The 3D printer ejects and cures droplets of a shaping material from a shaping-material ejection head to form a three-dimensional shaped object. The dispensing device ejects droplets of a sample and supplies a predetermined amount to a plurality of containers or the like.

A liquid ejection device which drives an actuator to eject ink and includes a plurality of nozzles drives a plurality of actuators at the same phase or drives the actuators with the phases shifted slightly in order to avoid the concentration of a drive current. However, if a plurality of actuators are driven at almost the same timing, the ink ejection may become unstable due to a crosstalk in which the operations of the actuators interfere with each other.

DESCRIPTION OF THE DRAWINGS

FIGS. 9A to 9C are distribution charts obtained by plotting channel numbers of channels arranged on the nozzle plate and magnitudes of pressure amplitudes which respective channels give to an attention channel 108;

FIG. 10 is a graph illustrating an amplitude waveform and a magnitude of amplitude in a residual vibration which is induced to the attention channel 108 while a channel 109 is driven;

DETAILED DESCRIPTION

Figure 1:
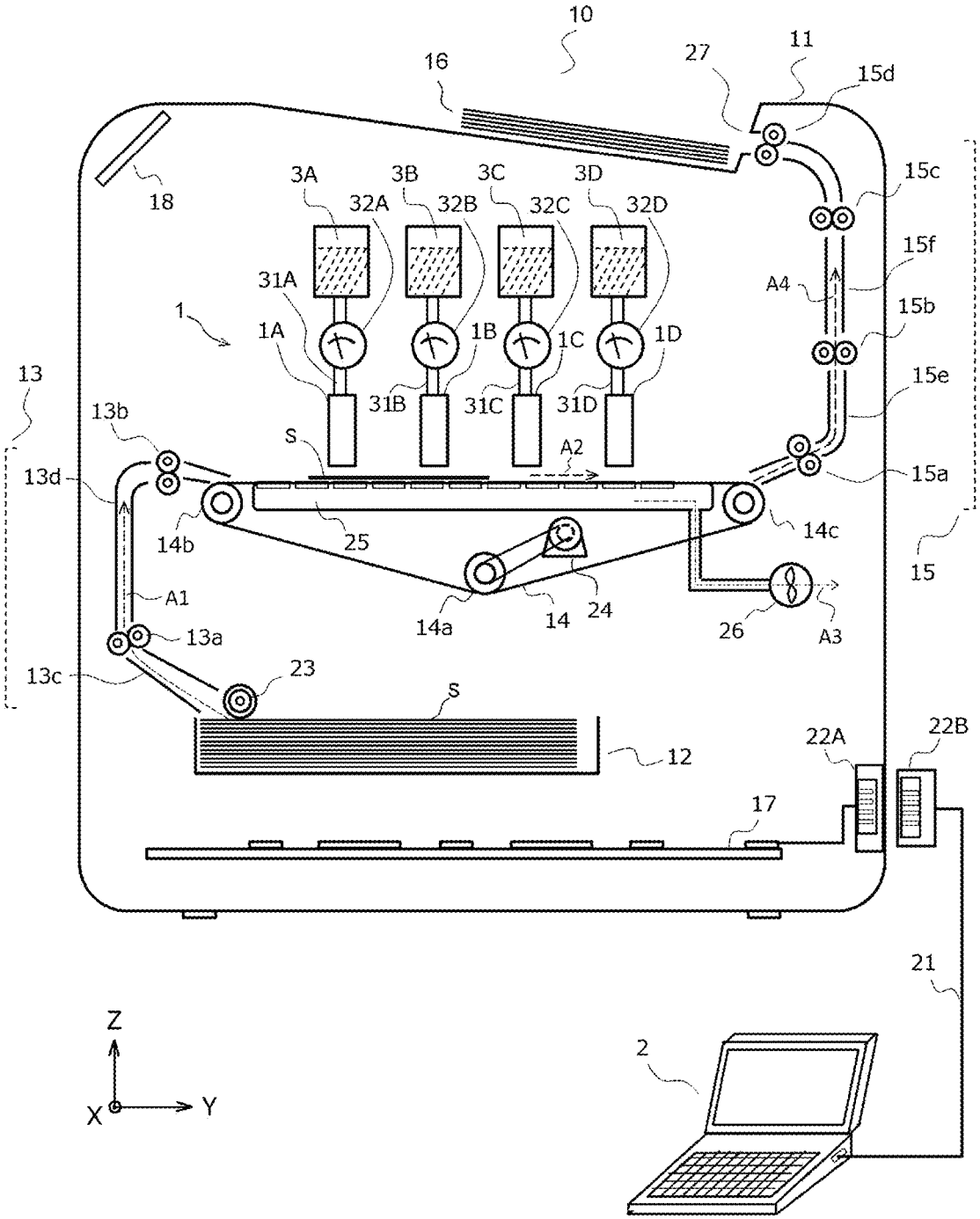
FIG. 1 is a configuration diagram of the entire inkjet printer according to a first embodiment.

Embodiments provide a liquid ejection device and an image forming device in which a stable liquid ejection can be performed by preventing a crosstalk in which operations of actuators interfere with each other.

In general, according to one embodiment, a liquid ejection device includes a nozzle plate in which nozzles for ejecting liquid are arranged, an actuator, a liquid supply unit, and a drive control unit. The actuator is provided in each of the nozzles. The liquid supply unit communicates with the nozzles. When one of a plurality of nozzles is given attention, the drive control unit gives drive signals to actuators of nozzles adjacent in an X direction and a Y direction, to drive the actuators at a timing shifted by a predetermined amount, such as half of a drive period or a quarter a drive period, from a timing of an actuator of the nozzle given attention.

Hereinafter, a liquid ejection device and an image forming device according to the embodiment will be described with reference to the accompanying drawings. In the drawings, the same configurations are denoted by the same reference numerals.

First Embodiment

An inkjet printer 10 which prints an image on a recording medium is described as one example of an image forming device mounted with a liquid ejection device 1 of an embodiment. FIG. 1 illustrates a schematic configuration of the inkjet printer 10. For example, the inkjet printer 10 includes a box-shaped housing 11 which is an exterior body.

A cassette 12 which stores a sheet S which is one example of the recording medium, an upstream conveyance path 13 of the sheet S, a conveyance belt 14 which conveys the sheet S picked up from the inside of the cassette 12, ink jet heads 1A to 1D which eject ink droplets toward the sheet S on the conveyance belt 14, a downstream conveyance path 15 of the sheet S, a discharge tray 16, and a control board 17 are arranged inside the housing 11. An operation unit 18 as a user interface is arranged on the upper side of the housing 11.

Data of the image printed on the sheet S is generated by a computer 2 which is external connection equipment, for example. The image data generated by the computer 2 is transmitted to the control board 17 of the inkjet printer 10 through a cable 21 and connectors 22B and 22A.

A pickup roller 23 supplies the sheets S one by one from the cassette 12 to the upstream conveyance path 13. The upstream conveyance path 13 is configured by a feed roller pair 13*a* and 13*b* and sheet guide plates 13*c* and 13*d*. The sheet S is fed to the upper surface of the conveyance belt 14 through the upstream conveyance path 13. An arrow A1 in the drawing indicates a conveyance path of the sheet S from the cassette 12 to the conveyance belt 14.

The conveyance belt 14 is a reticular endless belt in which a large number of through holes are formed on the surface. Three rollers, a drive roller 14*a* and driven rollers 14*b* and 14*c*, rotatably support the conveyance belt 14. A motor 24 rotates the conveyance belt 14 by rotating the drive roller 14*a*. The motor 24 is one example of a driving device. In the drawing, A2 indicates a rotation direction of the conveyance belt 14. A negative pressure container 25 is arranged on a back surface side of the conveyance belt 14. The negative pressure container 25 is connected to a fan 26 for reducing pressure, and the inner pressure of the container becomes negative by the air flow formed by the fan 26. When the inner pressure of the negative pressure container 25 becomes negative, the sheet S is sucked and held on the upper surface of the conveyance belt 14. In the drawing, A3 indicates the flow of air.

The inkjet heads 1A to 1D are arranged to face the sheet S sucked and held on the conveyance belt 14 through a slight gap of 1 mm, for example. The inkjet heads 1A to 1D each eject the ink droplets toward the sheet S. An image is formed on the sheet S when the sheet passes below the ink jet heads 1A to 1D. The ink jet heads 1A to 1D have the same structure except for the color of the ejected ink. The color of the ink is cyan, magenta, yellow, or black, for example.

The ink jet heads 1A to 1D are connected through ink passages 31A to 31D with ink tanks 3A to 3D and ink supply pressure adjusting devices 32A to 32D, respectively. For example, the ink passages 31A to 31D are resin tubes. The ink tanks 3A to 3D are containers which store ink. The ink tanks 3A to 3D are arranged above the ink jet heads 1A to 1D, respectively. During standby, the ink supply pressure adjusting devices 32A to 32D respectively adjust the inner pressures of the inkjet heads 1A to 1D to be negative compared to the atmospheric pressure, for example, −1 kPa, to prevent that the ink leaks out from nozzles 51 (see FIG. 2) of the ink jet heads 1A to 1D. During formation of an image, the inks of the ink tanks 3A to 3D are supplied to the ink jet heads 1A to 1D by the ink supply pressure adjusting devices 32A to 32D, respectively.

After forming the image, the sheet S is fed from the conveyance belt 14 to the downstream conveyance path 15. The downstream conveyance path 15 is configured by feed roller pairs 15*a*, 15*b*, 15*c*, and 15*d* and sheet guide plates 15*e* and 15*f* defining the conveyance path of the sheet S. The sheet S is fed from a discharge port 27 to the discharge tray 16 through the downstream conveyance path 15. In the drawing, an arrow A4 indicates the conveyance path of the sheet S.

Subsequently, the configuration of the ink jet head 1A will be described with reference to FIGS. 2 to 6. The ink jet heads 1B to 1D have the same structure as the ink jet head 1A, and the description is not given in detail.

Figure 2:
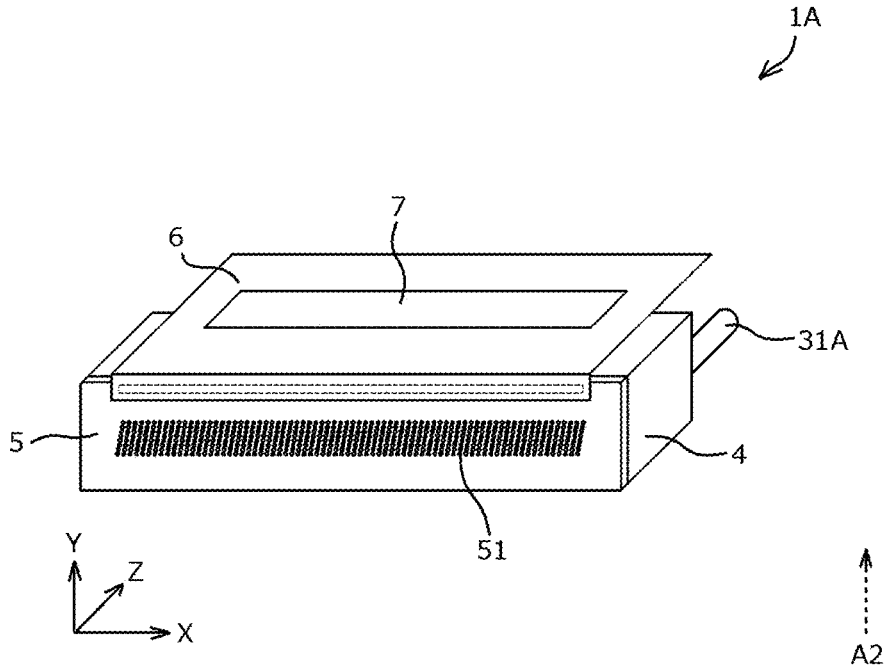
FIG. 2 is a perspective view of an ink jet head of the inkjet printer.

FIG. 2 is a perspective view of the appearance of the ink jet head 1A. The ink jet head 1A includes an ink supply unit 4 which is one example of a liquid supply unit, a nozzle plate 5, a flexible board 6, and a drive circuit 7. A plurality of nozzles 51 for ejecting ink are arranged in the nozzle plate 5. The ink ejected from the nozzles 51 is supplied from the ink supply unit 4 communicating with the nozzles 51. The ink passage 31A from the ink supply pressure adjusting device 32A is connected to the upper side of the ink supply unit 4. The drive circuit 7 is one example of a drive control unit. An arrow A2 indicates the rotation direction of the above-described conveyance belt 14 (see FIG. 1).

Figure 3:
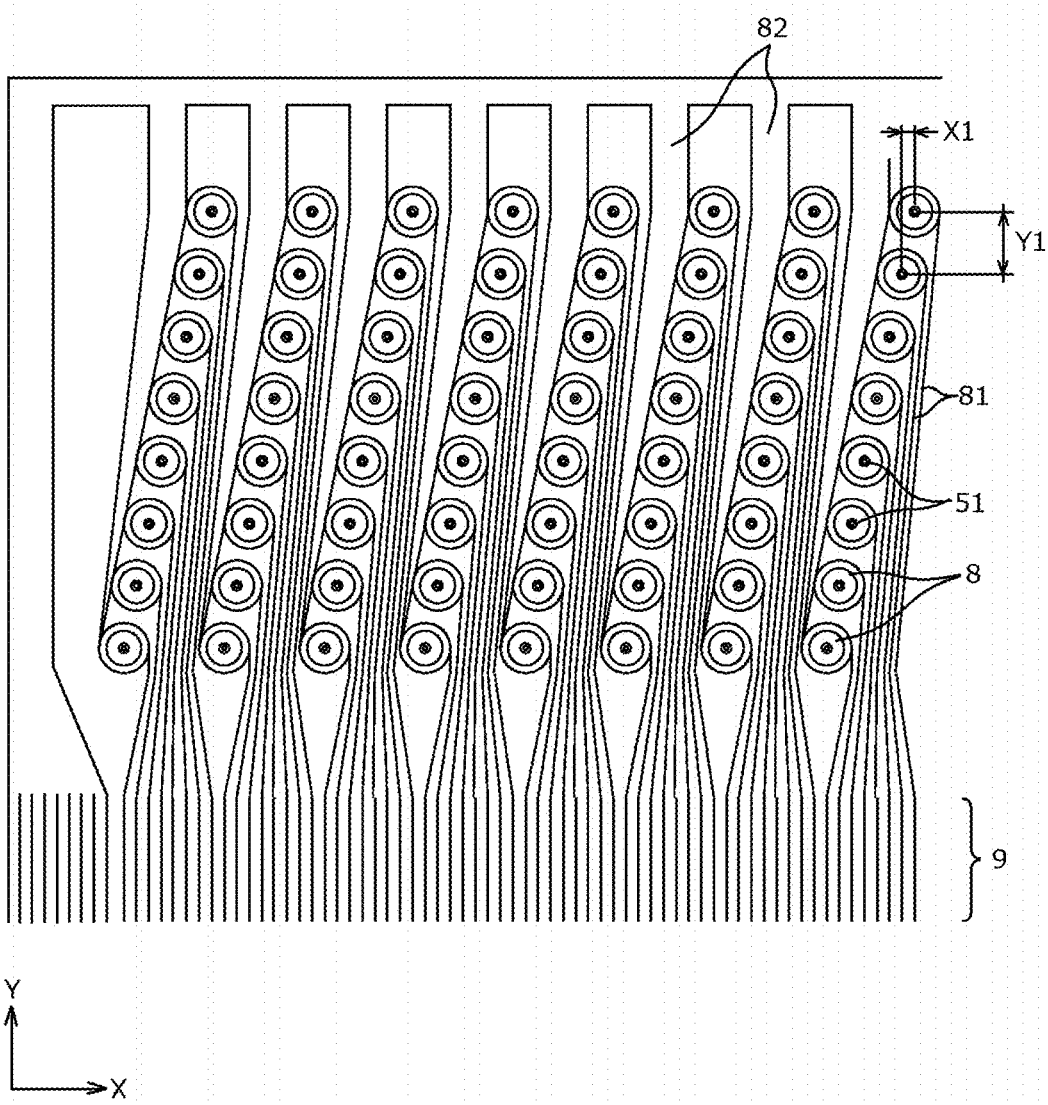
FIG. 3 is a plan view of a nozzle plate of the ink jet head.

FIG. 3 is an enlarged plan view partially illustrating the nozzle plate 5. The nozzles 51 are two-dimensionally arranged in a column direction (X direction) and a row direction (Y direction). However, the nozzles 51 arranged in the row direction (Y direction) are obliquely arranged such that the nozzles 51 are not overlapped on the axis of a Y axis. The nozzles 51 are arranged to have gaps of a distance X1 in the X-axis direction and a distance Y1 of in the Y-axis direction. As one example, the distance X1 is about 42.25 μm, and the distance Y1 is about 253.5 μm. That is, the distance X1 is determined such that a recording density of 600 DPI is formed in the X-axis direction. The distance Y1 is determined to print at 600 DPI in the Y-axis direction. When eight nozzles 51 arranged in the Y direction are set as one set, plural sets of nozzles 51 are arranged in the X direction. Although not illustrated, for example, 150 sets of nozzles are arranged in the X direction, and thus a total of 1,200 nozzles 51 are arranged.

An actuator 8 serving as a driving source of the operation of ejecting ink is provided at each of the nozzles 51. Each actuator 8 is formed in an annular shape and is arranged such that the nozzle 51 is positioned at the center thereof. One set of the nozzles 51 and the actuator 8 configure one channel. For example, the size of the actuator 8 is an inner diameter of 30 μm and an outer diameter of 140 μm. The actuators 8 are connected electrically with the individual electrodes 81, respectively. In the actuators 8, eight actuators 8 arranged in the Y direction are connected electrically by a common electrode 82. The individual electrodes 81 and the common electrodes 82 are connected electrically with a mounting pad 9. The mounting pad 9 serves as an input port for giving a drive signal (electric signal) to the actuator 8. The individual electrodes 81 give the drive signals to the actuators 8, respectively. The actuators 8 are driven according to the given drive signals. In FIG. 3, the actuator 8, the individual electrode 81, the common electrode 82, and the mounting pad 9 are described by a solid line for convenience of explanation. However, these units are arranged inside the nozzle plate 5 (see the longitudinal sectional view of FIG. 4). Naturally, the actuator 8 is not necessarily arranged inside the nozzle plate 5.

The mounting pad 9 is connected electrically with a wiring pattern formed in the flexible board 6 through an anisotropic contact film (ACF), for example. The wiring pattern of the flexible board 6 is connected electrically with the drive circuit 7. The drive circuit 7 is an integrated circuit (IC), for example. The drive circuit 7 generates the drive signal which is given to the actuator 8.

Figure 4:
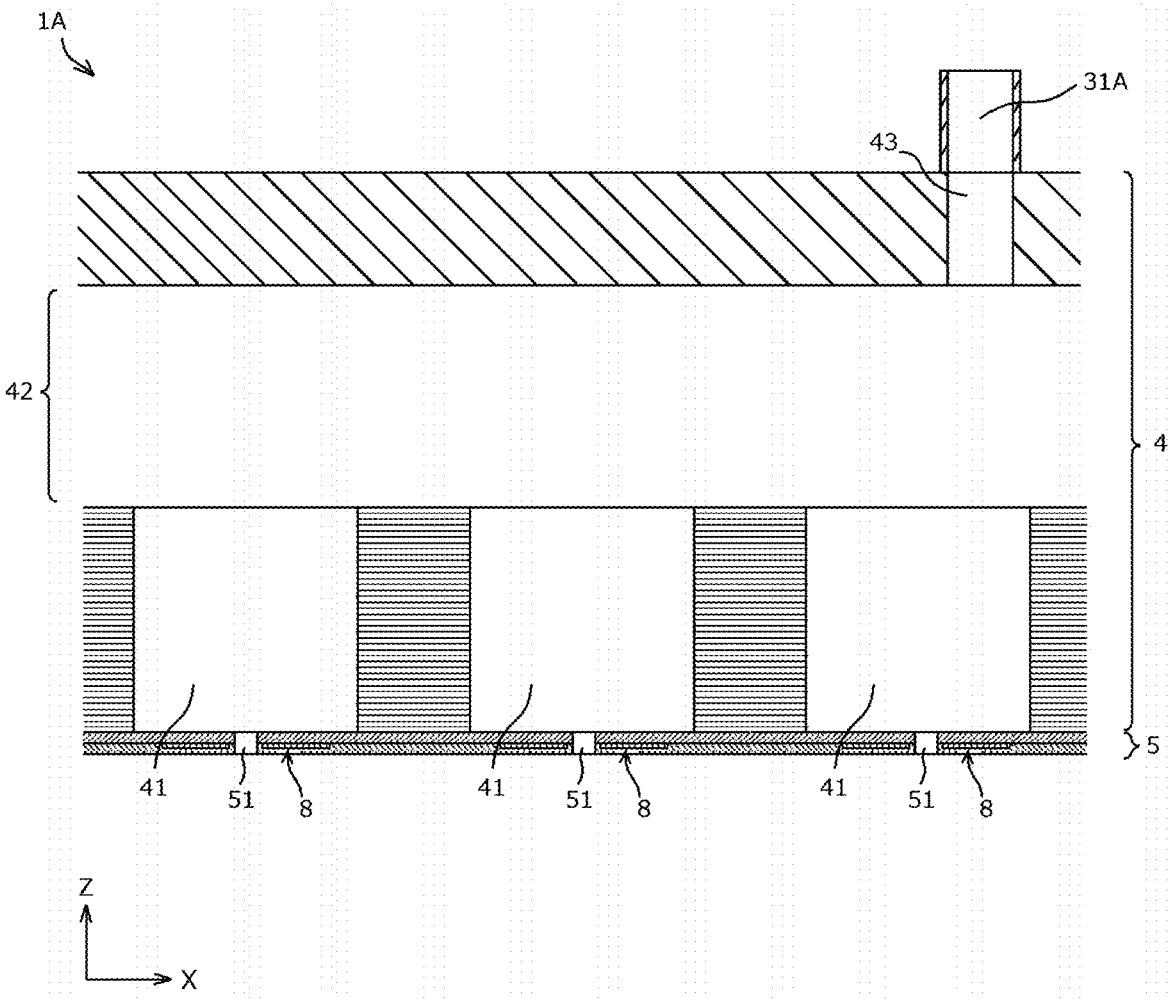
FIG. 4 is a longitudinal sectional view of the ink jet head.

FIG. 4 is a longitudinal sectional view of the ink jet head 1A. As illustrated in FIG. 4, the nozzle 51 penetrates the nozzle plate 5 in a Z-axis direction. For example, the size of the nozzle 51 is a diameter of 20 μm and a length of 8 μm. A plurality of pressure chambers (individual pressure chamber) 41 communicating with the respective nozzles 51 are provided inside the ink supply unit 4. The pressure chamber 41 is a cylindrical space of which the upper portion is open, for example. The upper portions of the pressure chambers 41 are open and communicate with a common ink chamber 42. The ink passage 31A communicates with the common ink chamber 42 through an ink supply port 43. The pressure chambers 41 and the common ink chamber 42 are filled with ink. In some cases, the common ink chamber 42 is formed in a passage shape for circulating ink, for example. For example, the pressure chamber 41 is configured such that a cylindrical hole having a diameter of 200 μm is formed in a single crystal silicon wafer having a thickness of 500 μm. For example, the ink supply unit 4 is configured such that the space corresponding to the common ink chamber 42 is formed in alumina ($Al_2O_3$).

Figure 5:
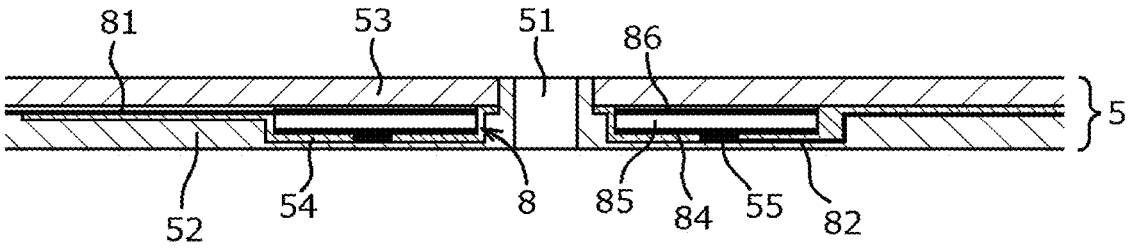
FIG. 5 is a longitudinal sectional view of the nozzle plate of the ink jet head.

FIG. 5 is an enlarged view partially illustrating the nozzle plate 5. The nozzle plate 5 has a structure in which a protective layer 52, the actuator 8, and a diaphragm 53 are laminated in order from the bottom surface side. The actuator 8 has a structure in which a lower electrode 84, a thin plate-shaped piezoelectric body 85 which is one example of a piezoelectric element, and an upper electrode 86 are laminated. The upper electrode 86 is connected electrically with the individual electrode 81, and the lower electrode 84 is connected electrically with the common electrode 82. An insulating layer 54 for preventing the short circuit of the individual electrode 81 and the common electrode 82 is interposed at the boundary between the protective layer 52 and the diaphragm 53. For example, the insulating layer 54 is formed of a silicon dioxide film ($SiO_2$) to have a thickness of 0.5 μm. The lower electrode 84 and the common electrode 82 are connected electrically by a contact hole 55 formed in the insulating layer 54. Considering piezoelectric property and dielectric breakdown voltage, the piezoelectric body 85 is formed of lead zirconate titanate (PZT) to have a thickness of 5 μm or less, for example. For example, the upper electrode 86 and the lower electrode 84 are formed of platinum to have a thickness of 0.15 μm. For example, the individual electrode 81 and the common electrode 82 are formed of gold (Au) to have a thickness of 0.3 μm.

The diaphragm 53 is formed of an insulating inorganic material. For example, the insulating inorganic material is silicon dioxide ($SiO_2$). For example, the thickness of the diaphragm 53 is 2 to 10 μm and preferably 4 to 6 μm. Although illustrated below in detail, the diaphragm 53 and the protective layer 52 are bent inward when the piezoelectric body 85 applied with voltage is deformed into a $d_{31}$ mode. Then, the diaphragm and the protective layer return to the original when the application of voltage to the piezoelectric body 85 is stopped. The volume of the pressure chamber (individual pressure chamber) 41 expands and contracts according to the reversible deformation. When the volume of the pressure chamber 41 is changed, the ink pressure in the pressure chamber 41 is changed.

For example, the protective layer 52 is formed of polyimide to have a thickness of 4 μm. The protective layer 52 covers one surface of the nozzle plate 5 on the bottom surface side and further covers the inner peripheral surface of the hole of the nozzle 51.

Figure 6:
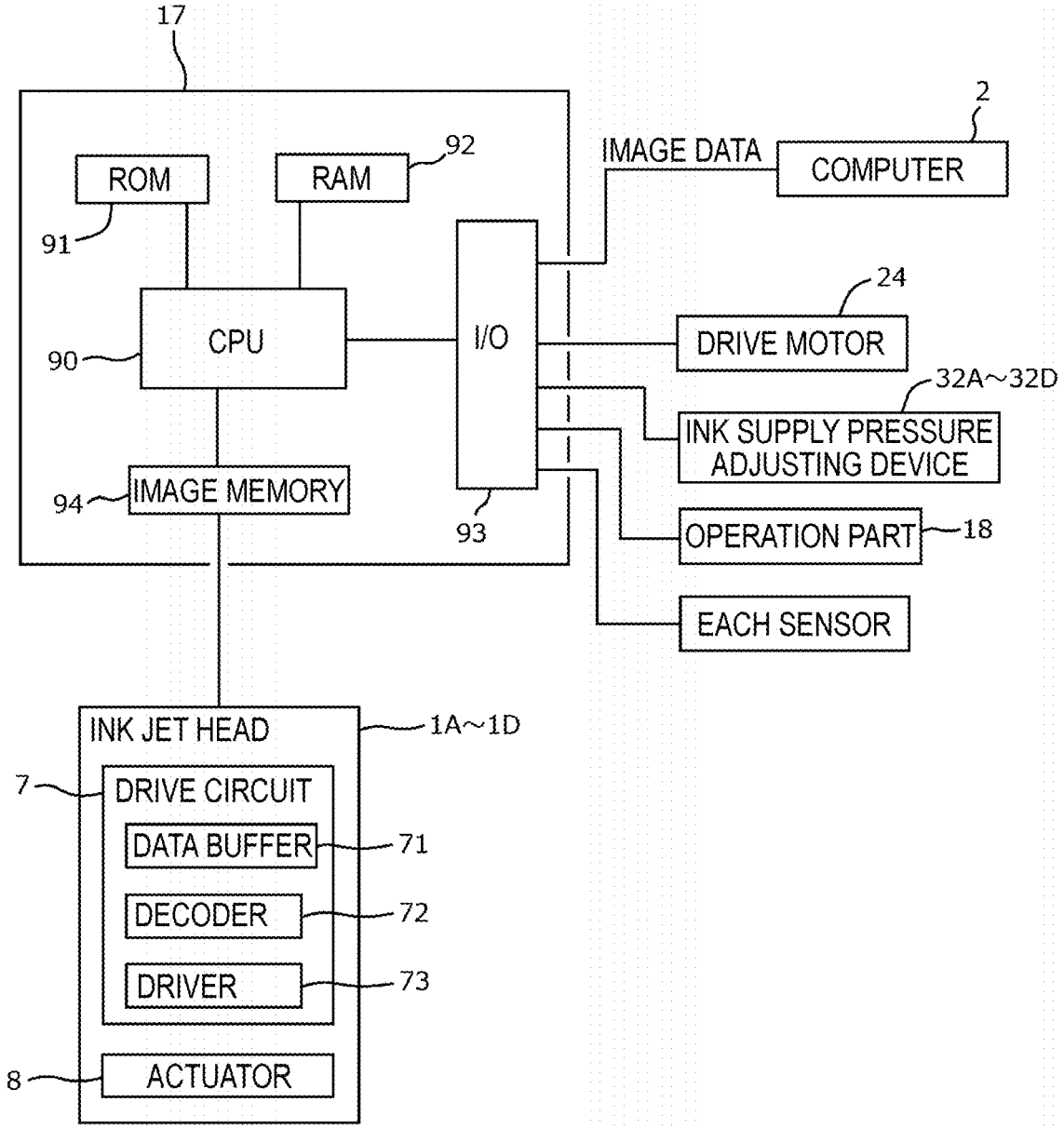
FIG. 6 is a block configuration diagram of a control system of the inkjet printer.

FIG. 6 is a functional block diagram of the inkjet printer 10. The control board 17 as a control unit is mounted with a CPU 90, an ROM 91, and an RAM 92, an I/O port 93 which is an input/output port, and an image memory 94. The CPU 90 controls the drive motor 24, the ink supply pressure adjusting devices 32A to 32D, the operation unit 18, and various sensors through the I/O port 93. Print data from the computer 2 which is external connection equipment is transmitted through the I/O port 93 to the control board 17 and is stored in the image memory 94. The CPU 90 transmits the print data stored in the image memory 94 to the drive circuit 7 in the drawing order.

The drive circuit 7 includes a print data buffer 71, a decoder 72, and a driver 73. The print data buffer 71 stores the print data in time series for each actuator 8. The decoder 72 controls the driver 73 based on the print data stored in the print data buffer 71 for each actuator 8. The driver 73 outputs the drive signal for operating each actuator 8 based on the control of the decoder 72. The drive signal is a voltage to be applied to each actuator 8.

Figure 7:
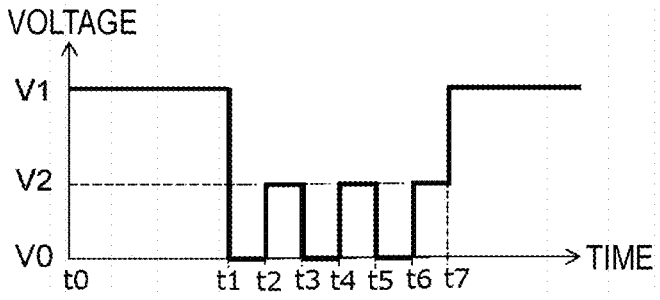
FIG. 7 is a view of a drive signal given to an actuator of the ink jet head.

Subsequently the drive waveform of the drive signal given to the actuator 8 and the operation of ejecting ink from the nozzle 51 are described with reference to FIGS. 7 to 8E. FIG. 7 illustrates a multi drop drive waveform of dropping ink droplets three times during one drive period by triple pulses as one example of the drive waveform. If the ink is dropped at a high speed, the ink becomes one droplet to impact the sheet S. The drive waveform of FIG. 7 is a so-called pulling striking of the drive waveform. However, the drive waveform is not limited to the triple pulses. For example, the drive waveform may be double pulses. The drive waveform is not limited to the pulling striking and may be a pushing striking or a pushing and pulling striking.

The drive circuit 7 applies a bias timings A1 to the actuator 8 from time t0 to time t1. That is, the voltage V1 is applied between the upper electrode 86 and the lower electrode 84. Then, after a voltage V0 (=0 V) is applied until time t2 from time t1 of starting ink ejection operation, a voltage V2 is applied from time t2 to time t3 to perform a first ink drop. After the voltage V0 (=0 V) is applied from time t3 to time t4, the voltage V2 is applied from time t4 to time t5 to perform a second ink drop. After the voltage V0 (=0 V) is applied from time t5 to time t6, the voltage V2 is applied from time t6 to time t7 to perform a third ink drop. If the ink is dropped at a high speed, the ink becomes one droplet to impact the sheet S. At time t7 after drop completion, the bias voltage V1 is applied to attenuate a vibration in the pressure chamber 41.

The voltage V2 is a voltage smaller than the bias voltage V1. For example, the voltage value is determined based on the attenuation rate of the pressure vibration of the ink in the pressure chamber 41. The time from time t1 to time t2, the time from time t2 to time t3, the time from time t3 to time t4, the time from time t4 to time t5, the time from time t5 to time t6, and the time from time t6 to time t7 are each set to a half period of a natural vibration period λ determined by the property of the ink and the inner structure of the head. The half period of the natural vibration period λ is also referred to as acoustic length (AL). During a series of operations, the voltage of the common electrode 82 is made constant at 0 V.

Figure 8A:
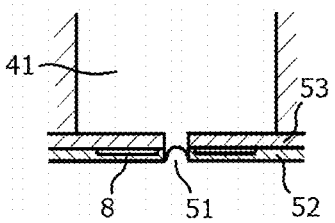
FIGS. 8A to 8E are views for explaining an operation of the actuator to which the drive signal is given.
Figure 8D:
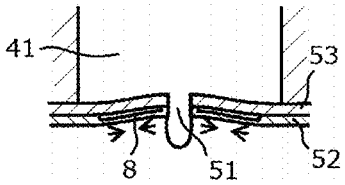
Figure 8B:
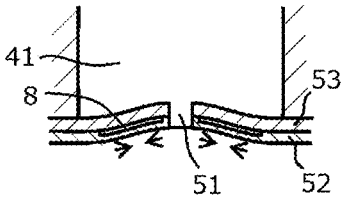
Figure 8E:
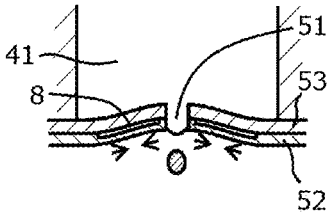

FIGS. 8A to 8E schematically illustrate the operation of driving the actuator 8 with the drive waveform of FIG. 7 to eject ink. In the standby state, the pressure chamber 41 is filled with ink. As illustrated in FIG. 8A, the meniscus position of the ink in the nozzle 51 is stationary near zero. When the bias voltage V1 is applied as a contraction pulse from time t0 to time t1, an electric field is generated in a thickness direction of the piezoelectric body 85, and the deformation of the $d_{31}$ mode occurs in the piezoelectric body 85 as illustrated in FIG. 8B. Specifically, the annular piezoelectric body 85 extends in the thickness direction and contracts in a radial direction. Although compressive stresses are generated in the diaphragm 53 and the protective layer 52 by the deformation of the piezoelectric body 85, the compressive force generated in the diaphragm 53 is larger than the compressive force generated in the protective layer 52, so that the actuator 8 is bent inward. That is, the actuator 8 is deformed to be a depression centered on the nozzle 51, and the volume of the pressure chamber 41 is contracted.

Figure 8C:
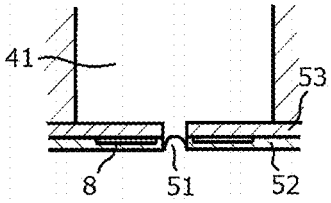

At time t1, when the voltage V0 (=0 V) is applied as an expansion pulse, the actuator 8 returns to a state before the deformation as schematically illustrated in FIG. 8C. At this time, in the pressure chamber 41, the inner ink pressure is lowered due to the return of the volume to the original state. However, ink is supplied from the common ink chamber 42 to the pressure chamber 41 so that the ink pressure rises. Thereafter, when the time reaches time t2, the ink supply to the pressure chamber 41 is stopped, and the rise of the ink pressure is also stopped. That is, the state becomes a so-called pulling state.

At time t2, as schematically illustrated in FIG. 8D, when the voltage V2 is applied as the contraction pulse, the piezoelectric body 85 of the actuator 8 is deformed again so that the volume of the pressure chamber 41 is contracted. As described above, the ink pressure rises between time t1 and time t2, and further the ink pressure is raised when the pressure chamber 41 is pushed by the actuator 8 to reduce the volume of the pressure chamber 41, so that the ink is extruded from the nozzle 51. The application of the voltage V2 continues to time t3, and the ink is ejected as a droplet from the nozzle 51 as schematically illustrated in FIG. 8E. That is, the first ink drop is performed.

When the voltage V2 is applied from time t4 to time t5 after the voltage V0 (=0 V) is applied from time t3 to time t4, the second ink drop is performed according to the same operation and effect (FIGS. 8B to 8E). When the voltage V2 is applied from time t6 to time t7 after the voltage V0 (=0 V) is applied from time t5 to time t6, the third ink drop is performed according to the same operation and effect (FIGS. 8B to 8E).

When the third drop is performed, at time t7, the voltage V1 is applied as a cancel pulse. The inner ink pressure of the pressure chamber 41 is lowered by ejecting ink. The vibration of the ink remains in the pressure chamber 41. In this regard, the actuator 8 is driven such that the voltage V2 is changed to the voltage V1 to contract the volume of the pressure chamber 41, and the inner ink pressure of the pressure chamber 41 is made substantially zero, thereby forcibly reducing the residual vibration of the ink in the pressure chamber 41.

Herein, the property of the pressure vibration transmitted to peripheral channels when the actuator 8 is driven is described based on the result of the test performed by using the ink jet head 1A in which 213 channels are arranged two-dimensionally in the nozzle plate 5. As described above, one channel is configured by one set of the nozzle 51 and the actuator 8. FIG. 9A illustrates channel numbers allocated to the 213 channels arranged in an XY direction. Naturally, the channels arranged in the Y-axis direction are obliquely arranged in practice as illustrated in FIG. 3. In the following, right and left (X direction) sides, upper and lower (Y direction) sides, and an oblique side are mentioned for convenience of explanation of the positional relation between the channels.

For example, when a channel 108 which is one of the 213 channels is given attention, and other channels are driven individually, the distribution diagram of FIG. 9B is obtained by plotting the magnitudes of the pressures given to the attention channel 108. The channel is driven by giving a step waveform to the actuator 8. The step waveform is a waveform for measurement which contracts the actuator 8 only once as illustrated in FIG. 9C. A period after the contraction is set as a measurement period. The numerical value in each cell of the distribution diagram of FIG. 9B is a maximum value of a residual vibration amplitude induced to the attention channel 108 during the measurement period after the drive signal is given to the driven channel. A voltage value (mV) of the piezoelectric effect generated in the piezoelectric body 85 of the actuator 8 of the attention channel 108 is used as the value indicating the magnitude of the residual vibration amplitude.

More specifically, the maximum value of the residual vibration amplitude is calculated as follows. For example, the pressure waveform of FIG. 10 is obtained when the channel 109 next to the right side of the attention channel 108 is driven, and the residual vibration which is induced to the attention channel 108 is expressed by the voltage value (mV) of the piezoelectric effect generated in the piezoelectric body 85. At this time, when a section of 8 μs is moved along a time axis, and a width between a maximum value and a minimum value of the section is plotted, a waveform of "a width of maximum and minimum values of the residual vibration" in the same drawing is obtained. Then, the maximum value of the plotted width is plotted as the maximum value of the residual vibration in FIG. 9B. The maximum value of "the width of maximum and minimum values of the residual vibration" of the channel 109 is 135 mV. For the remaining channels, the maximum value of "the width of maximum and minimum values of the residual vibration" is measured by the same procedure.

From the result of FIG. 9B, it is understood that the effect of the vibration to the attention channel 108 from the channels 109 and 108 adjacent to the upper and lower sides of the attention channel 108 is the largest. It is understood that the effect of the vibration from the channels 100 and 116 adjacent to the right and left sides is the next largest. That is, in order that the effect from the peripheral channels is reduced such that the channel performs a stable ejection, particularly, the effect of the vibration from the channels on the upper and lower sides and the right and left sides is desirably reduced as much as possible.

Figure 11:
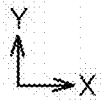
FIG. 11 is a distribution chart obtained by plotting the channel numbers of the channels arranged on the nozzle plate and magnitudes of pressures which respective channels give to the attention channel 108.

Subsequently, the distribution diagram of FIG. 11 is obtained when the magnitude of the pressure given to the attention channel 108 is plotted. The numerical value in each cell of the distribution diagram of FIG. 11 indicates the magnitude of the pressure generated in the attention channel 108 when ten seconds elapse after the drive signal is given to the channel. A positive value indicates a positive pressure, and a negative value indicates a negative pressure. A voltage value (mV) of the piezoelectric effect generated in the piezoelectric body 85 of the actuator 8 of the attention channel 108 is measured as the value indicating the magnitude of the pressure.

As illustrated in the distribution diagram of FIG. 11, the channels surrounding the attention channel 108 generate pressure at almost the same phase as each other (the range of the positive value), and further the channels surrounding the outer periphery thereof reversely generate pressure at the almost reverse phases (the range of the negative value). That is, a distance from the attention channel 108 to the area of the channel group which generates the reverse-phase pressure corresponds to a half wavelength of the pressure vibration which is transmitted while spreading along the surface of the nozzle plate 5. That is, the half wavelength of the pressure vibration which is transmitted while spreading along the surface of the nozzle plate 5 is longer than a pitch (adjacent distance) of the channels arranged in the nozzle plate 5 in a surface direction. For this reason, the pressure vibrations of the channels, which have a positional relation of being close to each other, such as adjacent channels are in phase.

Figure 12:
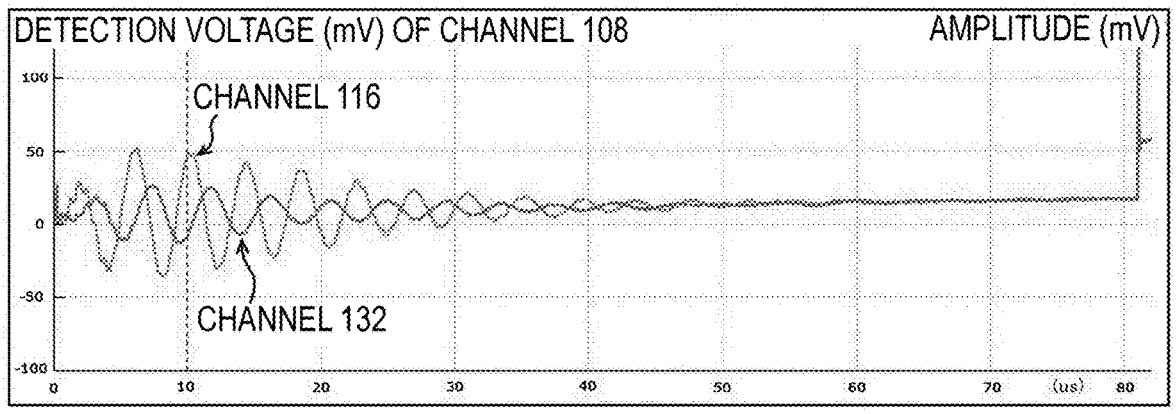
FIG. 12 is a graph illustrating pressure waveforms (residual vibration waveform) appearing in the attention channel 108 when a channel 116 and a channel 132 are driven individually.

The waveform diagram of FIG. 12 illustrates the respective pressure waveforms (residual vibration waveform) appearing in the attention channel 108 when a channel 116 and a channel 132 are driven individually. The channel 116 is next to the right side of the attention channel 108. The channel 132 is positioned at the third right position from the attention channel 108. In the pressure waveform (residual vibration waveform), a vertical axis indicates the voltage value (mV) of the piezoelectric effect representing the magnitude of the pressure, and a horizontal axis indicates time (μs). The natural pressure vibration period λ of the ink jet head 1A is 4 μs, and the half period (AL) thereof is 2 μs. From the result, it is understood that the pressure given to the attention channel 108 varies in the magnitude and the phase depending on the places of the driven channels.

Figure 13:
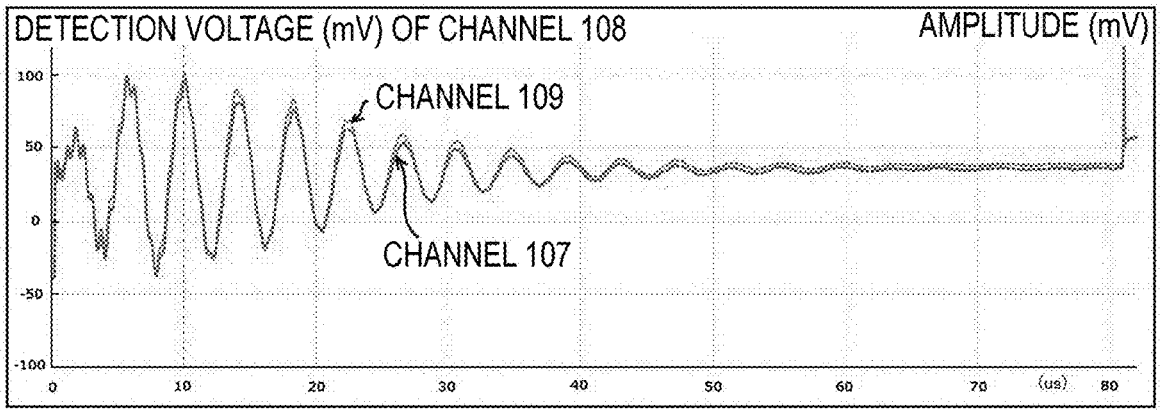
FIG. 13 is a graph illustrating pressure waveforms (residual vibration waveform) appearing in the attention channel 108 when a channel 109 and a channel 107 are driven individually.

On the other hand, the waveform diagram of FIG. 13 illustrates the respective pressure waveforms (residual vibration waveform) appearing in the attention channel 108 when a channel 109 and a channel 107 are driven individually. The channel 109 is next to the upper side of the attention channel 108. The channel 107 is next to the lower side of the attention channel. From the result, it is understood that the pressure waveforms which the channels next to the upper side and the lower side of the attention channel give to the attention channel are similar.

Figure 14:
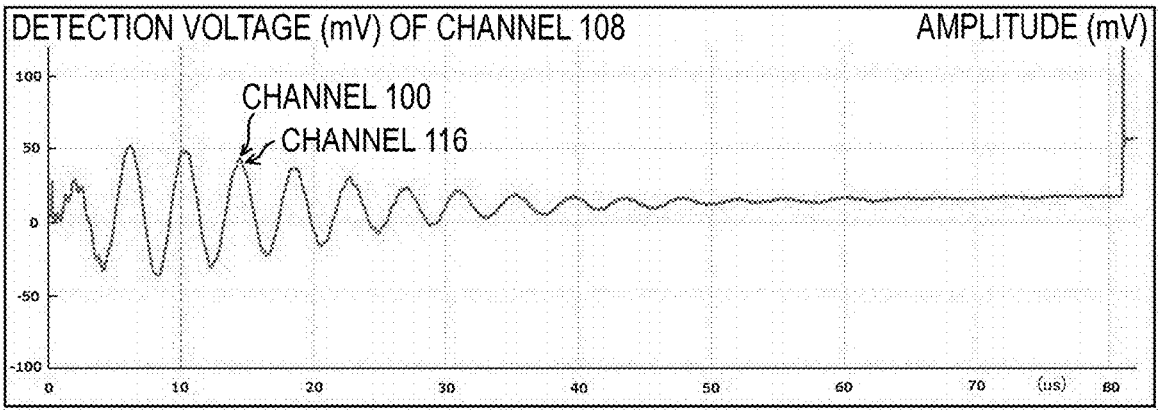
FIG. 14 is a graph illustrating pressure waveforms (residual vibration waveform) appearing in the attention channel 108 when a channel 100 and the channel 116 are driven individually.

The waveform diagram of FIG. 14 illustrates the respective pressure waveforms (residual vibration waveform) appearing in the attention channel 108 when a channel 100 and the channel 116 are driven individually. The channel 100 is next to the left side of the attention channel 108. The channel 116 is next to the right side of the attention channel 108. From the result, it is understood that the pressure waveforms which the channels next to the left side and the right side of the attention channel give to the attention channel are almost identical.

Figure 15:
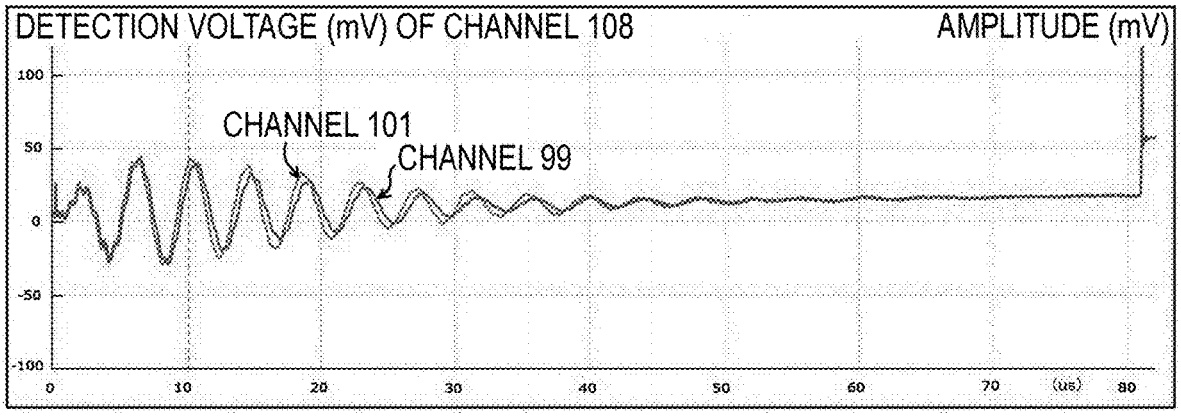
FIG. 15 is a graph illustrating pressure waveforms (residual vibration waveform) appearing in the attention channel 108 when a channel 101 and a channel 99 are driven individually.

The waveform diagram of FIG. 15 illustrates the respective pressure waveforms (residual vibration waveform) appearing in the attention channel 108 when a channel 101 and a channel 99 are driven individually. The channel 101 is next to the upper left side of the attention channel 108. The channel 99 is next to the lower left side of the attention channel 108. From the result, it is understood that the pressure waveforms which the channels next to the obliquely upper left side and the obliquely lower left side of the attention channel give to the attention channel are also similar.

Figure 16:
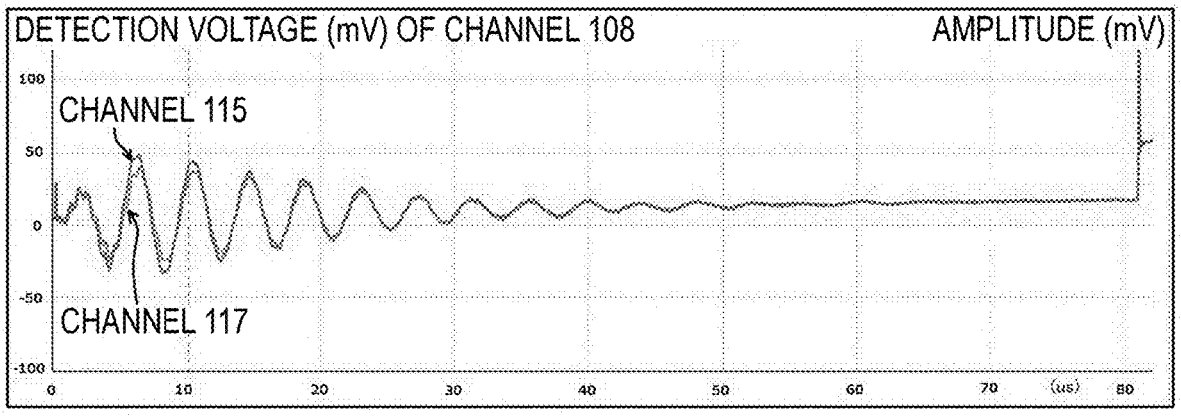
FIG. 16 is a graph illustrating pressure waveforms (residual vibration waveform) appearing in the attention channel 108 when a channel 117 and a channel 115 are driven individually.

The waveform diagram of FIG. 16 illustrates the respective pressure waveforms (residual vibration waveform) appearing in the attention channel 108 when a channel 117 and a channel 115 are driven individually. The channel 117 is next to the upper right side of the attention channel 108. The channel 115 is next to the lower right side of the attention channel 108. From the result, it is understood that the pressure waveforms which the channels next to the obliquely upper right side and the obliquely lower right side of the attention channel give to the attention channel are also similar.

From the results illustrated in FIGS. 11 to 16, it is understood that the channels which are positioned to be symmetrical to the attention channel give almost the same pressure vibration to the attention channel. That is, the channels adjacent to the right and left sides (X direction) of the attention channel, the channels adjacent to the upper and lower sides (Y direction) of the attention channel, and the channels adjacent to the obliquely upper and obliquely lower sides of the attention channel are each positioned to be symmetrical to the attention channel and each give almost the same pressure vibration to the attention channel.

Figure 17:
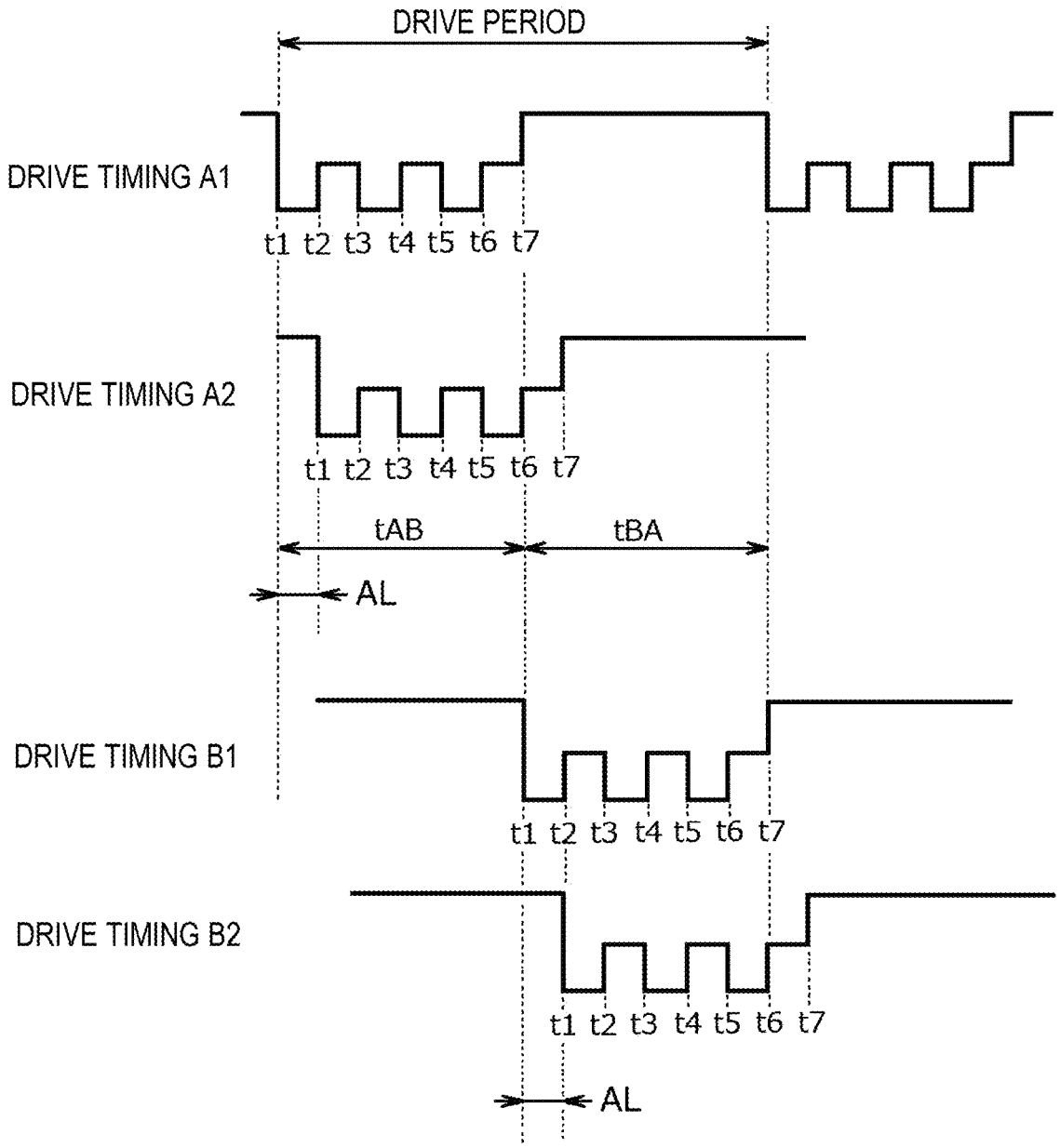
FIG. 17 is a view for explaining four drive timings A1, A2, B1, and B2 in which time differences (delay time) are set between drive waveforms for driving channels.

Based on the above results, four drive timings A1, A2, B1, and B2 in which time differences (delay time) are set between the drive waveforms given to the plural actuators 8 are prepared as one example is illustrated in FIG. 17. The drive waveform of a group A configured by the drive timings A1 and A2 and the drive waveform of a group B configured by the drive timings B1 and B2 are shifted to each other by a half of the drive period. One drive period is configured by a time tAB of performing the ejection operation of a former half portion and a time tBA of the standby until the next ejection operation is started. As one example, if each pulse of the drive waveform from time t1 to time t7 is set to the half period AL of the natural vibration period λ, and the drive period of the ink jet head is 24 μs, the time tAB of the ejection operation is 12 μs. Preferably, the time tAB of the ejection operation and the time tBA of the standby are the same time or almost the same time.

Even in the drive waveforms of the group A, the drive waveform of the drive timing A1 and the drive waveform of the drive timing A2 are shifted by the half period AL (a half of λ) of the natural pressure vibration period λ. Similarly, even in the drive waveforms of the group B, the drive waveform of the drive timing B1 and the drive waveform of the drive timing B2 are shifted by the half period AL (a half of λ) of the natural pressure vibration period λ. However, the drive waveforms may have phases reverse to each other, and the shifted time (delay time) is not limited to the half period (1AL). The shifted time may be odd times the half period AL.

Figure 18:
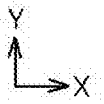
FIG. 18 is a matrix in which the drive timings A1, A2, B1, and B2 are regularly allocated to all the channels and which illustrates a distribution of the delay times of respective channels.

As one example is illustrated in FIG. 18, the drive timings A1, A2, B1, and B2 are regularly allocated to all the 213 channels, to form a checkered pattern. That is, the drive timing (B1 or B2) of the group B is allocated to all the channels adjacent to the upper and lower sides and the right and left sides of the channel to which the drive timing (A1 or A2) of the group A is allocated. Conversely, the drive timing (A1 or A2) of the group A is allocated to all the channels adjacent to the upper and lower sides and the right and left sides of the channel to which the drive timing (B1 or B2) of the group B is allocated. In the channel at a corner, naturally, the channels adjacent to one side of upper and lower sides and one side of the right and left sides become targets.

In the channels adjacent to the upper and lower sides of the channel to which the drive timing (A1 or A2) of the group A is allocated, the drive timing B1 is allocated to one channel, and the drive timing B2 is allocated to the other channel. In the channels adjacent to the right and left sides, the drive timing B1 is allocated to one side, and the drive timing B2 is allocated to the other side. That is, the channels adjacent to the upper and lower sides and the channels adjacent to the right and left sides each are a pair of channels which are driven by the drive waveforms with reverse phases.

Similarly, in the channels adjacent to the upper and lower side of the channel to which the drive timing (B1 or B2) of the group B is allocated, the drive timing A1 is allocated to one channel, and the drive timing A2 is allocated to the other channel. In the channels adjacent to the right and left sides, the drive timing A1 is allocated to one channel, and the drive timing A2 is allocated to the other channel. That is, the channels adjacent to the upper and lower sides and the channels adjacent to the right and left sides each are a pair of channels which are driven by the drive waveforms with reverse phases.

That is, in the 213 channels of FIG. 18, even when any channel is given attention, the drive period between the channels adjacent to the upper and lower sides of the channel and the drive period between the channels adjacent to the right and left sides of the channel are shifted by a half.

If the drive period is short, the printing speed is fast. The drive period is determined from the printing speed required for a printer. When the drive period is a predetermined value, tAB is set to be equal to tBA, such that any channel is driven at the timing separated as far as possible from the drive timings of the channels adjacent to the upper and lower sides and the right and left sides. Accordingly, it is possible to reduce the crosstalk from the channels which are adjacent to the upper and lower sides and the right and left sides and to which the channel is most susceptible. The channels adjacent to the upper and lower sides and the channels adjacent to the right and left sides each are a pair of channels which are driven by the drive waveforms with phases reverse to each other. Thus, the effects of the pressures on the channel positioned at the center thereof are canceled by each other. That is, as described above, the channels adjacent to the upper and lower sides and the right and left sides are channels which are positioned to be symmetrical to the attention channel. The channels which are positioned symmetrically give the pressure vibration with almost the same or similar waveforms to the attention channel. Therefore, when both channels are driven at the same timing (in-phase), the vibrations are added to each other to amplify the pressure vibration, which is given to the attention channel. However, when the drive timings are shifted by the half period, and the channels are driven in the drive waveforms with reverse phases, the pressure vibrations with the reverse phases in which the vibrations are canceled by each other are given to the attention channel.

The drive waveforms illustrated in FIGS. 7 and 17 are multi-drop waveforms of ejecting three small drops while forming one dot. In the multi-drop waveforms illustrated in FIGS. 7 and 17, the ejections of the small drops are performed at times t2, t4, and t6 with the timing when the voltage V2 is given to the actuator as a starting point. The time from time t1 to time t2, the time from time t2 to time t3, the time from time t3 to time t4, the time from time t4 to time t5, the time from time t5 to time t6, and the time from time t6 to time t7 are each set to the half period (AL) of the natural vibration period λ. The drive timing A2 is delayed by the half period (AL) from the drive timing A1. The drive timing B2 is delayed by the half period (AL) from the drive timing B1. Therefore, the drive timing A1 and the drive timing A2 of the multi-drop waveform are driven at the reverse phases whenever small drops are ejected. The drive timing B1 and the drive timing B2 of the multi-drop waveform are driven at the reverse phases whenever small drops are ejected. For this reason, in the multi-drop waveform, the crosstalk is reduced more effectively. Naturally, the multi-drop waveform is not limited to the multi-drop waveform which ejects three small drops while forming one dot. For example, a multi-drop waveform may be used which ejects two or four small drops while forming one dot. The effect of reducing the above-described crosstalk can be obtained although the drive waveform is not necessarily a multi-drop waveform. That is, the drive waveform is not limited to the multi-drop waveform.

When the checkered pattern is allocated as illustrated in FIG. 18, in the channel adjacent to any one of the right and left sides of the attention channel and the channel adjacent to any one of the upper and lower sides, a pair of channels are driven by drive waveforms with the reverse phases or are driven by in-phase drive waveforms. Even in this case, in the pair of channels driven by the drive waveforms with the reverse phases, the pressure vibrations of the reverse phases in which the vibrations are canceled by each other are given to the attention channel. The channels next to the obliquely upper left side, the obliquely lower left side, the obliquely upper right side, and the obliquely lower right side have the same drive period as the attention channel and have the group A of the drive timings. However, the channels next to the obliquely upper left side and the obliquely lower left side and the channels next to the obliquely upper right side and the obliquely lower right are each driven by the drive waveforms with phase reverse to each other, and thus the pressure vibrations with the reverse phases in which the vibrations are canceled by each other are given to the attention channel.

FIG. 18 is one example of the drive timings A1, A2, B1, and B2 allocated to the 213 channels. However, even if the number of the channels is 213 or more, the stable ejection can be performed by allocating the drive timings A1, A2, B1, and B2 with the same regularity.

Second Embodiment

Figure 19:
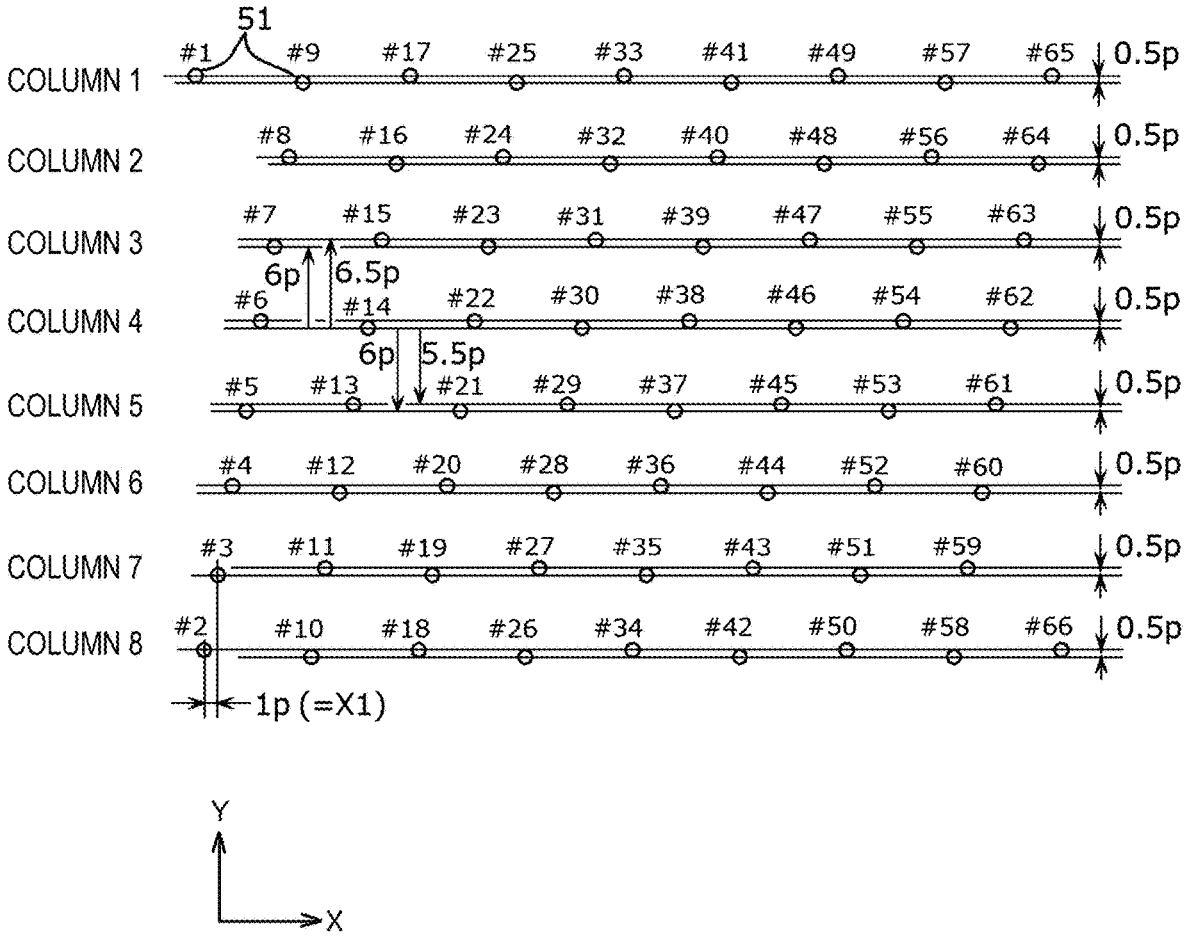
FIG. 19 is an arrangement view of nozzles of an ink jet head which is one example of a liquid ejection device of a second embodiment.

Subsequently, the liquid ejection device 1 of a second embodiment will be described. FIG. 19 is a nozzle arrangement when the sheet S is viewed from the Z-axis direction in FIG. 1 through the ink jet head 1A which is one example of the liquid ejection device 1. That is, FIG. 19 is a projection plan view of the nozzle arrangement. The reference numerals #1 to #66 in the drawings indicate the channel numbers corresponding to those of FIG. 9A, and the nozzles 51 subsequent to the channel number 66 are not illustrated for convenience. The configuration of the actuator 8 or the like is the same as in the ink jet head 1A of the first embodiment except for the nozzle arrangement. Therefore, the description is not given in detail.

As illustrated in FIG. 19, the nozzles 51 arranged in the column direction (X direction) are arranged alternately to be separated by a predetermined distance in the Y-axis direction. For example, in column 1, a nozzle 51 group of #1, #17, #33, #49, and #65 are separated by a predetermined distance in the Y-axis direction from a nozzle 51 group of #9, #25, #41, and #57. That is, the nozzles are arranged with a relative shift in the Y-axis direction. When a distance X1 between the nozzles is defined as "1 p", the distance of the relative shift in the Y-axis direction is 0.5 p. When all the nozzle 51 from columns 1 to 8 are set as targets and viewed from the Y direction, the distance X1 between the nozzles is a nozzle pitch in the X direction. The pitch of the nozzles 51 in the X direction in the same column is 8 p. Similarly, the nozzles 51 arranged in columns 2 to 8 in the column direction (X direction) are shifted alternately in the Y-axis direction. However, the rows of the nozzles 51 shifted in the Y-axis direction are formed to alternate with those of the upper and lower columns. Thus, the checkered pattern is formed by the nozzles 51 shifted in the Y-axis direction and the nozzles 51 not shifted.

In the arrangement of the checkered pattern as above, for example, if the nozzle 51 of #14 is given attention, the nozzle 51 of #22 adjacent in the X direction and the nozzle 51 of #6 adjacent in the −X direction are separated by a distance of 0.5 p in the Y-axis direction from the nozzle 51 of #14 given attention. In the nozzle 51 of #15 adjacent in the Y direction, the separation distance from the nozzle 51 of #14 given attention in the Y-axis direction is 6.5 p. In the nozzle 51 of #13 adjacent in the −Y direction, the separation distance from the nozzle 51 of #14 given attention in the Y-axis direction is 5.5 p. That is, when any one of a plurality of nozzles 51 is given attention, the nozzle 51 given attention and the nozzles 51 adjacent in the X direction and the −X direction are arranged to be relatively shifted by the distance of 0.5 p in the Y-axis direction. The nozzle 51 may be arranged such that when the separation distance of the nozzles 51 adjacent in the Y direction and the −Y direction from the nozzle 51 given attention in the Y-axis direction is 6.5 p for one nozzle 51, the separation distance is 5.5 p for the other nozzle 51. In the nozzle 51 itself given attention, the nozzle is arranged to be relatively shifted by the distance of 0.5 p in the Y-axis direction from the nozzles 51 adjacent to the upper and lower sides and the right and left sides in the X direction, the −X direction, the Y direction, and the −Y direction.

Figure 20:
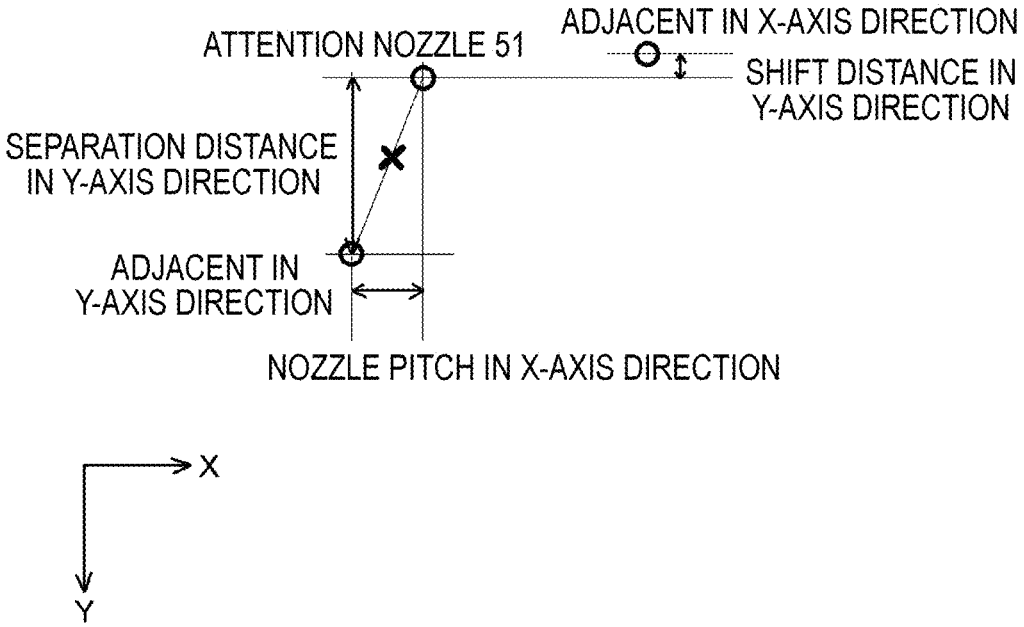
FIG. 20 is a view for explaining a positional relation and a distance of the nozzles.

The nozzles 51 adjacent in the X direction, the nozzles 51 adjacent in the Y direction, the shift distance in the Y-axis direction, and the separation distance in the Y-axis direction satisfy the positional relation and the distance of the nozzles 51 illustrated in FIG. 20. That is, the nozzles 51 adjacent in the X direction are the nozzles 51 adjacent in the same column and are not necessarily on the X axis. The same is applied to the case of the −X direction. The nozzles 51 adjacent in the Y direction are the nozzles 51 arranged obliquely and adjacent on the same row and are not necessarily on the Y axis. The same is applied to the case of the −Y direction. The shift distance of the Y-axis direction and the separation distance of the Y-axis direction are the separation distance on the Y axis. The Y axis is a direction of a relative movement of the ink jet head 1A and the sheet S when the image or the like is printed on the sheet S.

p indicates a dot pitch of the dot which is formed on the sheet S when the ink jet head 1A ejects ink. In the case of the ink jet head 1A of 600 DPI, it is satisfied that p≅42.25 μm. Accordingly, it is satisfied that 0.5 p≅21.13 μm, 5.5 p≅232.38 μm, and 6.5 p≅274.63 μm. If the shift of 0.5 p is not provided, all the separation distances of the nozzles 51 adjacent in the Y direction in the Y-axis direction are 6 p (≅253.5 μm). p may be defined not to be associated with the dot pitch and, for example, may be defined by the nozzle pitch (=X1) in the X direction.

0.5 p, 5.5 p, and 6.5 p are respective examples of the set distance. The distance by which the nozzles 51 adjacent in the X direction and the −X direction are shifted in the Y-axis direction is not limited to 0.5 p and may be set according to Expression (m+0.5)p. The character m is a natural number including 0. The separation distances of the nozzles 51 adjacent in the Y direction and the −Y direction in the Y-axis direction are not limited to 6.5 p and 5.5 p and may be set according to Expression (n+0.5)p and Expression (n−0.5)p. n is a natural number not including 0. That is, any set distance is odd times a half of P.

As described above, Y in FIG. 19 is a direction of the relative movement of the ink jet head 1A and the sheet S when an image or the like is printed on the sheet S. For example, if the sheet S is directed to the lower side of the ink jet head 1A from the −Y direction, the nozzles 51 facing the sheet S first are the nozzles 51 of #10, #26, #42, and #58 of column 8, and after the delay of the time required for sheet conveyance of the distance of 0.5 p, the nozzles 51 of #2, #18, #34, #50, and #66 of the same column face the sheet S. When facing the sheet S, the nozzles 51 are positioned in a printing range of the sheet S.

Thereafter, after the delay of the time required for the sheet conveyance of the distance of 5.5 p, the nozzles 51 of #3, #19, #35, and #51 arranged in column 7 face the sheet S, and after the delay of the time required for the sheet conveyance of the distance of 0.5 p, the nozzles 51 of #11, #27, #43, and #59 of the same column face the sheet S.

Thereafter, after the delay of the time required for the sheet conveyance of the distance of 6.5 p, the nozzles 51 of #12, #28, #44, and #60 arranged in column 6 face the sheet S, and after the delay of the time required for the sheet conveyance of the distance of 0.5 p, the nozzles 51 of #4, #20, #36, and #52 of the same column face the sheet S.

If the drive timings illustrated in FIG. 18 are set for respective channels, in the nozzles 51 of #9, #16, #41, #48, . . . , #19, #26, #51, and #58, the actuators 8 are driven at the drive timing of A1. In the nozzles 51 of #25, #32, #57, #64, . . . , #3, #10, #35, and #42, the actuators 8 are driven at the drive timing of A2. In the nozzles 51 of #8, #33, #40, #65, . . . , #11, #18, #32, and #50, the actuators 8 are driven at the drive timing of B1. In the nozzles 51 of #17, #24, #49, #56, . . . , #2, #27, #34, #59, and #66, the actuators 8 are driven at the drive timing of B2.

As for the nozzle 51 of #14 which is previously given attention, the actuator 8 of the nozzle 51 of #14 is driven at the drive timing of A2 in the group A (A1 and A2). All the actuators 8 of the nozzles 51 of #6 and #22 adjacent on the right and left sides in the X direction and the −X direction and the nozzles 51 of #13 and #15 adjacent on the upper and lower sides in the Y direction and the −Y direction are driven at the drive timing of the group B (B1 and B2) which is shifted by a half of the drive period from that of the nozzle 51 of #14. During the execution of printing, the nozzles 51 having the drive timings of the group A are driven, and then after the delay of the time of a half of the drive period, the nozzles 51 having the drive timings of the group B are driven. However, the nozzles 51 having the drive timings of the group B face the sheet S after the delay of 0.5 p from the nozzles 51 having the drive timings of the group A. Thus, although the nozzles are driven at the timing delayed by a half of the drive period, the printing results of the group A and the group B are arranged on one straight line on the sheet S.

The time difference of the drive timings of B1 and B2 and the time difference of the drive timings of A1 and A2 are slight and thus do not affect linearity. Although there is an effect, the effect is extremely small.

The direction of the relative movement of the ink jet head 1A and the sheet S may be a single-pass type in which the ink jet head 1A is fixed, and the sheet S moves in one direction of the Y-axis direction. However, for example, a scan type may be adopted in which the ink jet head 1A and the sheet S move relatively in the X-axis direction. In the case of the scan type, the direction in which the ink jet head 1A moves during the printing operation is set to X. Thus, similarly to the previous one, the nozzles 51 of #10, #26, #42, and #58 of column 8 first face the sheet S, and after the delay of the time required for the head movement of the distance of 0.5 p, the nozzles 51 of #2, #18, #34, #50, and #66 of the same column face the sheet S.

As described above, in the second embodiment, in the nozzle 51 of the drive timing of the group B, the actuator 8 is driven at the timing delayed by a half of the drive period from that of the nozzle 51 of the drive timing of the group A. That is, the channel is driven at the timing separated as far as possible from the drive timings of the channels adjacent to the upper and lower sides and the right and left sides. Thus, it is possible to reduce the crosstalks from the channels which are adjacent to the upper and lower sides and the right and left sides and to which the channel is most susceptible. When the position of the nozzle 51 is shifted by odd times a half of the dot pitch or the nozzle pitch in a feed direction (Y-axis direction) of the sheet S, the linearity of the printing result can be maintained although the channel is driven at the timing delayed by a half of the drive period.

Hereinbefore, the configuration in which the nozzle arrangement is associated with the drive timing is described as one preferable example. However, the association with the delay timing is not necessary.

Third Embodiment

Figure 21:
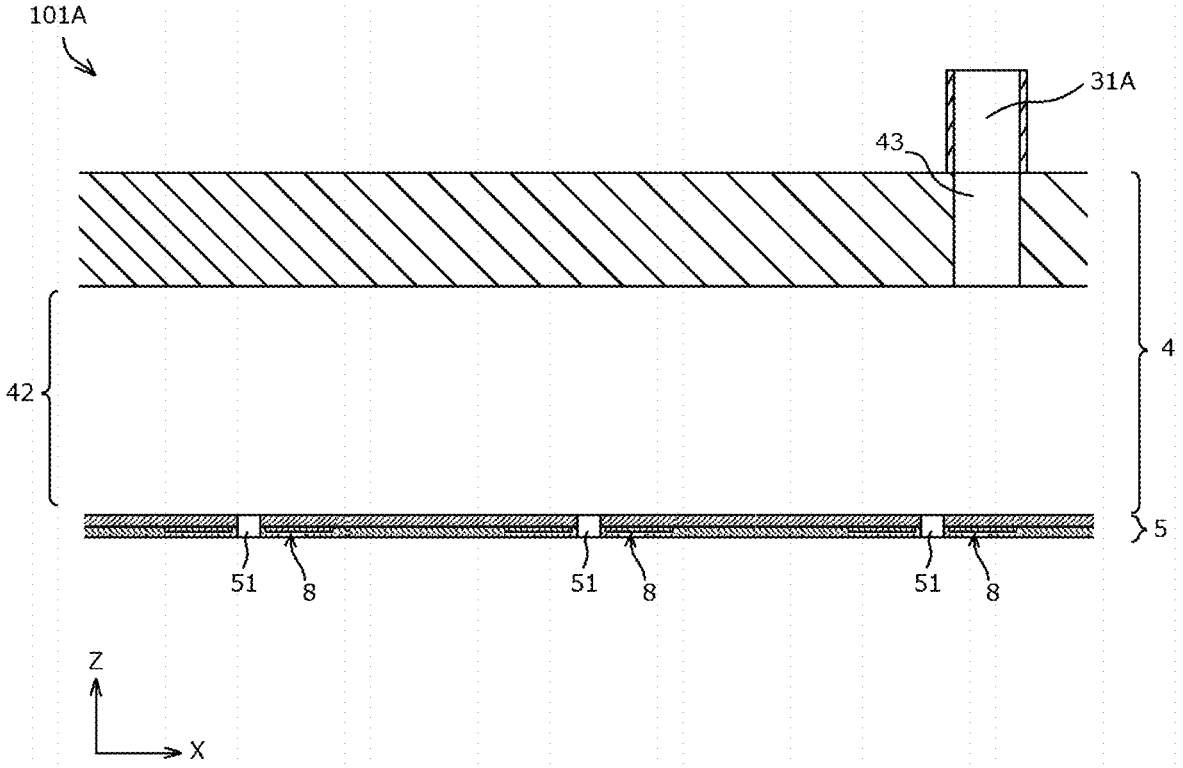
FIG. 21 is a longitudinal sectional view of an ink jet head which is one example of a liquid ejection device of a third embodiment.

Subsequently, a liquid ejection device of a third embodiment will be described. FIG. 21 illustrates a longitudinal sectional view of the ink jet head 101A as one example of the liquid ejection device. The ink jet head 101A is configured to be the same as the ink jet head 1A illustrated in the first embodiment except that the pressure chamber (individual pressure chamber) 41 is not provided, and the nozzle plate 5 communicates directly with the common ink chamber 42. Accordingly, the same configurations as the ink jet head 1A are denoted by the same reference numerals, and the detail description is not given.

Also in the ink jet head 101A illustrated in FIG. 21, all the channels are driven such that the drive timings A1, A2, B1, and B2 of the checkered pattern are allocated as one example is illustrated in FIG. 18.

According to any one embodiment described above, the drive timings A1, A2, B1, and B2 of the checkered pattern are allocated as one example is illustrated in FIG. 18. Thus, even when any channel is given attention, the drive periods of the channels adjacent to the upper and lower sides and the right and left sides are shifted by a half. Thus, when the ejection operation is performed on the channel at the center, the channel is hardly affected by the pressure vibration from the channels adjacent to the upper and lower sides and the right and left sides. As a result, the crosstalk in which the operations of the actuators interfere with each other can be prevented, and liquid can be ejected stably.

That is, in the ink jet heads 1A and 101A, the actuator 8 and the nozzle 51 are arranged on the surface of the nozzle plate 5. In this case, when the plurality of actuators 8 are driven simultaneously, the surface of the nozzle plate 5 is bent, and the crosstalk in which the operation of the actuator 8 interferes with the operation of another actuator 8 occurs due to the reason that the pressure change from the peripheral actuators 8 has an effect through the common ink chamber 42. In this regard, when the drive timings are allocated as described above, the crosstalks from the peripheral actuators 8 is prevented.

In the above-described embodiments, the actuators of the nozzles adjacent to the right and left sides, the actuators of the nozzles adjacent to the upper and lower sides, and the actuators of the nozzle adjacent to any one of the right and left sides and the nozzle adjacent to any one of the upper and lower sides are each driven by the drive waveforms with phases reverse to each other. However, any one may be driven as above, and all the actuators do not necessarily satisfy all conditions.

In the above-described embodiment, the ink jet heads 1A and 101A of the inkjet printer 1 are described as one example of the liquid ejection device. However, the liquid ejection device may be a shaping-material ejection head of a 3D printer and a sample ejection head of a dispensing device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection device, comprising:

a nozzle plate in which a plurality of nozzles for ejecting liquid are arranged two-dimensionally in an XY direction;

an actuator provided in each of the nozzles;

a liquid supply unit configured to communicate with the nozzles; and a drive control unit configured to, when one nozzle among the plurality of nozzles is given attention, give drive signals to actuators of nozzles adjacent the one nozzle at least one of an X direction and a −X direction, at least one of a Y direction and a −Y direction to drive the actuators at a timing shifted by half of a drive period from a timing of an actuator of the one nozzle given attention.

2. The device according to claim 1, wherein the drive control unit configured to, when one nozzle among the plurality of nozzles adjacent the one nozzle in an X direction, a −X direction, a Y direction and a −Y direction to drive the actuators at a timing shifted by half of a drive period from a timing of an actuator of the one nozzle given attention.

3. The device according to claim 1, wherein a half wavelength of a vibration along a surface direction of the nozzle plate when the actuator is driven is longer than a pitch of arrangement of the actuator.

4. The liquid ejection device according to claim 1, the drive control unit being further configured to, when one of the plurality of nozzles is given attention, give drive signals to actuators of nozzles adjacent the one nozzle in an X direction and a Y direction, such that the actuators of the nozzles adjacent the one nozzle in the X direction, the actuators of the nozzles adjacent the one nozzle in the Y direction, or the actuators of the nozzles adjacent the one nozzle in the X direction and the actuactors of the nozzle adjacent the one nozzle in the Y direction are driven by drive waveforms with phases reverse to each other.

5. The device according to claim 4, wherein a half wavelength of a vibration along a surface direction of the nozzle plate when an actuator is driven is longer than a pitch of arrangement of the actuators.

6. A liquid ejection device, comprising:

a nozzle plate in which a plurality of nozzles for ejecting liquid are arranged two-dimensionally in an XY direction;

an actuator provided in each of the nozzles;

a liquid supply unit configured to communicate with the nozzles; and a drive control unit configured to, when one of the plurality of nozzles is given attention, give drive signals to an actuator of a nozzle adjacent the one nozzle in an X direction and an actuator of a nozzle adjacent the one nozzle in a −X direction such that drive waveforms have phases reverse to each other, and give drive signals to an actuator of a nozzle adjacent the one nozzle in a Y direction and an actuator of a nozzle adjacent the one nozzle in a −Y direction such that drive waveforms have phases reverse to each other.

7. The device according to claim 6, wherein a half wavelength of a vibration along a surface direction of the nozzle plate when an actuator is driven is longer than a pitch of arrangement of the actuators.

8. A liquid ejection device in which a plurality of nozzles for ejecting liquid are arranged two-dimensionally in an XY direction, wherein when one nozzle of the plurality of nozzles is given attention, nozzles adjacent the one nozzle in an X direction and a −X direction are positioned such that a shift distance from the one nozzle given attention in a Y-axis direction is (m+0.5)p, nozzles adjacent the one nozzle in a Y direction are positioned such that a separation distance from the one nozzle in the Y-axis direction is (n+0.5)p, and nozzles adjacent the one nozzle in a −Y direction are positioned such that a separation distance from the one nozzle in the Y-axis direction is (n−0.5)p, wherein m is a natural number including zero, n is a natural number not including zero, and p is a dot pitch of a dot formed by the ejected liquid.

9. A liquid ejection device in which a plurality of nozzles for ejecting liquid are arranged two-dimensionally in an XY direction, wherein when one nozzle of the plurality of nozzles is given attention, nozzles adjacent the one nozzle in an X direction and a −X direction are positioned such that a shift distance from the one nozzle given attention in a Y-axis direction is (m+0.5)p, nozzles adjacent the one nozzle in a Y direction are positioned such that a separation distance from the one nozzle in the Y-axis direction is (n+0.5)p, and nozzles adjacent the one nozzle in a −Y direction are positioned such that a separation distance from the one nozzle in the Y-axis direction is (n−0.5)p, wherein m is a natural number including zero, n is a natural number not including zero, and p is a nozzle pitch in the X direction.

* * * * *